United States Patent [19]

Berlant

[11] 4,348,549

[45] Sep. 7, 1982

[54] LOUDSPEAKER SYSTEM

[76] Inventor: Emmanuel Berlant, 9118 Olin St., Los Angeles, Calif. 90034

[21] Appl. No.: 28,599

[22] Filed: Apr. 9, 1979

Related U.S. Application Data

[63] Continuation of Ser. No. 975,593, Feb. 6, 1978.

[51] Int. Cl.[3] ..... H04R 1/20

[52] U.S. Cl. ..... 179/1 E; 181/152; 181/155; 181/195

[58] Field of Search ..... 179/1 E, 1 G, 1 A; 181/144–156, 195, 199, 159, 177, 191, 192

[56] References Cited

U.S. PATENT DOCUMENTS

| | | | |
|---|---|---|---|
| 1,692,994 | 11/1928 | Mattis . | |
| 1,855,147 | 8/1932 | Jones | 179/1G |
| 2,035,108 | 3/1936 | Weil | 181/152 |
| 2,138,717 | 11/1938 | Volk | 181/151 |
| 2,820,525 | 1/1958 | Fountain et al. . | |
| 2,982,372 | 5/1961 | Lowell | 181/155 |
| 3,169,601 | 2/1965 | Smith | 181/156 |
| 3,326,321 | 6/1967 | Valuch | 181/144 |
| 3,327,808 | 6/1967 | Shaper | 181/153 |
| 3,329,235 | 7/1967 | Shaper . | |
| 3,816,672 | 6/1974 | Gefuert et al. | 179/1 E |
| 3,866,710 | 2/1975 | Cesati | 181/159 |
| 4,058,675 | 11/1977 | Kobayashi et al. | 179/1 GA |

FOREIGN PATENT DOCUMENTS

| | | | |
|---|---|---|---|
| M24325 | 9/1956 | Fed. Rep. of Germany | 181/152 |
| 581589 | 12/1924 | France | 181/191 |
| 931952 | 3/1948 | France | 179/115.5 H |
| 1077151 | 11/1954 | France | 181/155 |

*Primary Examiner*—Vincent P. Canney
*Attorney, Agent, or Firm*—William W. Glenny

[57] ABSTRACT

A loudspeaker system for radiating acoustic output throughout 360° in generally horizontal planes, comprising an enclosure having low frequency (woofer) and high frequency (tweeter) radiators mounted in spaced relation on a common vertical axis. The horn loaded compression driver tweeter is the upper of the two and has a diaphragm radiating axially upwardly into a flaring horn, preferably exponential, including an intermediate annular section which abruptly reflects sound waves approximately 90° into a radial outlet section of the horn radiating approximately horizontally through 360°, providing the known advantages of horn loaded compression drivers in a radically more compact form than conventional horn speakers. The woofer radiates axially downwardly, and a conical plug spaced downwardly from the speaker cone serves to load the cone for higher efficiency and smoother response, and to deflect acoustic output of the cone generally horizontally through 360° in a $2\pi$ steradian loading of the floor plane. The preferred enclosure for the system is rectangular in cross section, providing space for four triangular shaped vertical corner passages to vent the enclosed woofer housing. The axial positioning of the speakers permits counter-acting phase mismatch at the crossover frequency. Major portions of the system are well adapted to being economically fabricated of molded rigid polyurethane foam or similar plastic material.

7 Claims, 5 Drawing Figures

60
62
64
57
50
52
54
66
68
56
70
12
30
53
44
28
46
42
40
36
38
26
22
10
20
33
24
37
31
91
92
III
III
80
82
14
88
84
90
86
89
90

LOUDSPEAKER SYSTEM

This is a continuation of application Ser. No. 875,593, filed Feb. 6, 1978.

BACKGROUND AND SUMMARY OF THE INVENTION

The present invention relates generally to acoustic radiators, and more particularly to a loudspeaker system for radiating wide band acoustic energy generally horizontally throughout an angle of 360°.

Many attempts have been made in the prior art to provide radiators or loudspeakers for radiating acoustic energy multi-directionally, and more especially throughout 360° in a generally horizontal plane. Three such early attempts are disclosed in U.S. Pat. Nos. 1,692,994 to Mattis, 1,918,366 to Abrahams, and 2,065,367 to Evans, and more recent proposals are exemplified by the constructions shown in the U.S. Pat. Nos. 2,820,525 to Fountain and 3,329,235 to Shaper, and the references cited therein. Conventional high fidelity sound equipment of recent years provides at least two radiators; a tweeter for radiating acoustic output having frequencies above a given crossover frequency, and a woofer for radiating acoustic output having frequencies below the crossover frequency.

The system of the present invention contemplates the provision of a tweeter and a woofer mounted on a common vertical axis and radiating in opposite directions on that axis. In the preferred form of the invention hereinafter described and illustrated in detail, the horn loaded tweeter is the upper of the two radiators, and radiates upwardly, the woofer being the lower radiator and radiating downwardly toward the floor or other supporting surface for the assembly. Means are provided in accordance with the invention for dispersing the acoustic output of each of the speakers in generally horizontal planes, i.e. at approximately 90° from the common vertical axis of the radiators, and throughout 360° in those planes.

In the present invention the means for changing direction of the acoustic output of the tweeter includes a horn having an element, preferably conical, for abruptly reflecting the wave front impinging thereon outwardly through a 360° radial mouth while at the same time continuing the desirable exponential rate of flare of the cross-sectional area of the horn passage. This reflective construction avoids the loss of high frequency response which the provision of a conventionally curved horn would cause.

The major factor affecting the change of direction of sound energy in a bent horn is diffraction: as the sound waves advance along the horn into the bend, the curving walls of the horn present an obstacle on one side and a release from confinement on the opposite side. If the radial dimensions of the horn at the bend are a small fraction of the wavelength of the sound, the wave front will change its path by diffracting away from the obstructive wall with very little loss, retaining the waveguide effectiveness of the horn through the bend. However, as shorter wavelengths of higher frequency sound approach the radial dimensions of the bend the decreasing interval between the compression wave fronts limits the diffractive action, forcing the acoustic impulses against the impeding wall of the horn, resulting in destructive reflection and random dissipation of the sound energy. The losses due to diffraction roughly approximate the ratio of the radial dimensions at the bend to the wavelength of the energy, and such losses become a serious factor in limiting the high frequency capability of a conventional bent horn.

A second major factor adversely affecting the high frequency response of a bent horn is the difference in path length between the inside and outside radii of the bend in the horn; when this effective path length differential becomes one half wavelength, out of phase cancellation causes nullification of the sound energy, with proportional losses at lesser phase shifts.

As a result of these combined losses the use of conventional bent horns as known to the art is restricted to limited bandwidth applications.

In the present invention a novel means is used to overcome the described deficiencies of conventional bent horns. The compression driver and an exponentially flared horn form an axial horn section coupled to an exponentially flared radial horn which distributes the sound energy uniformly through 360° in a plane normal to the axial horn. The upper surface of this radial horn section contains a central conical element of approximately 90° included angle that combines the conventional diffracting function of a bent horn with a mirror imaging reflecting function which maintains the high frequency response to the limits of the driver's capability.

The conical element of the radial horn is positioned with its apex toward and coaxial with the driver. The base diameter of the cone is made approximately equal to the diameter of the axial horn in the plane of the apex of the cone. High frequency sound of wavelengths subtended by each face of the cone will be totally reflected at right angles out through the mouth of the radial horn. Sound of lower frequencies will be reflected in proportion to the ratio of the radius of the cone base to the wavelength of the sound. There are no path length differences in the reflected sound.

It is easily perceived that lower frequency sound of wavelength substantially greater than the radial dimensions of the horn in the bend will be changed 90° in direction by the diffractive function described, and radiated 360° in a plane normal to the axis of the driver; that high frequency sound of wavelength equal to or less than the radius of the base of the cone will be fully reflected 90° directly out the mouth of the radial horn, and that sounds intermediate in wavelength will likewise be changed 90° in direction by a combination of diffraction and reflection actions as described, in complementary proportion to their wavelength, thus providing uniform transmission of sound energies of all frequencies within the design parameters of the horn.

With reference to the woofer in accordance with the present invention, the change of direction of the acoustic output is accomplished by the provision of a loading plug having an upper face which is approximately congruent with the contour of the speaker cone, but spaced to provide at least clearance for cone movement. The interaction between the woofer cone and the loading plug is analogous to that of a flat rigid piston compliably mounted in a flat baffle, and facing a flat rigid surface. Movement of the piston toward the opposing surface will result in a compression wave front which will be vented radially at the perimeter of the baffle. For a given excursion of the piston, the amplitude of the wave front at the periphery will increase as the spacing between the baffle and the opposing surface is reduced, and the back pressure on the face of the cone will similarly increase. This results in increased acoustic resistance, and therefore in increased speaker efficiency.

The woofer of the present invention, moreover, is preferably mounted in a vented enclosure. As will be later described in detail, the mounting structure for the present loudspeaker assembly is generally rectangular in shape, and in each of the four corners of the structure, surrounding the woofer proper, there is provided a diagonal panel, thus creating a total of four downwardly opening triangular ducts extending vertically in the structure. Thus, within a structure which is generally conventional in appearance, there is provided a set of venting ducts having substantially greater length than conventional ducts which typically run laterally into the enclosure. This extra duct length substantially contributes to the bass effectiveness of the entire assembly, since it permits, for a given woofer and volume of enclosure, a larger duct area. Moreover, the acoustic energy from the ducts is radiated symmetrically about the system, and the relatively larger wall surface of the four ducts provides increased boundry flow resistance as compared with the case of a single ducted vent of equivalent length and cross-sectional area, a condition contributing to critical damping. The actual cross-sectional area of the vents and their length are determined in accordance with principles well known in the art, as described in articles in the technical literature, including A. N. Thiele, "Loudspeakers in Vented Boxes," J. Audio Eng'g. Soc., Vol. 19, May, 1971, pp. 382–392; and R. J. Newman, "A. N. Thiele—Sage of Vented Speakers," AUDIO Magazine, Aug., 1975, pp. 30–37.

The present invention provides an additional advantage in minimizing phase mismatch in the region of the crossover frequency, as perceived from any direction radially about the central axis of the system. As is known in the art, conventional 12 db per octave crossover networks produce a phase shift of 180° between the high and low band pass signals. In the system of the present invention, since the radiators are mounted coaxially and since the direction of their energy output is changed by approximately 90°, a listener perceives the sound of each as emanating from a virtual source spaced behind the central axis by a distance equal to the axial distance from the respective diaphragm to the central plane of the respective circumferential outlet mouth. Since the phase angle of the high pass filter output is advanced 90° relative to the input signal, and the phase angle of the low pass filter is retarded 90° relative thereto, the phase mismatch at the crossover frequency is eliminated when the length of the central axial tweeter horn is selected to equalize the difference in displacement, radially of the central axis, between the virtual positions of the two sound sources and the linear equivalent of the phase shift caused by the crossover network.

It is accordingly a principal object of the present invention to provide novel tweeter and woofer assemblies coaxially mounted in an improved omniradial loudspeaker system combining the excellent stereophonic lateral placement effect achievable with conventional "point source" loudspeakers with the uniform acoustic energy distribution and freedom from positioning problems characteristic of "diffuse source" systems. Other objects are to provide an extended high frequency wide band tweeter having a horn including means for changing direction of its acoustic energy by 90° and radiating that energy uniformly throughout 360° about the axis of the tweeter; to provide a woofer and means for optimizing and changing direction of its acoustic energy by 90° and radiating that energy uniformly throughout 360° about the axis of the woofer; to provide novel means for venting the acoustic energy from the rear of the cone of the woofer; to provide, in a loudspeaker system having a tweeter and a woofer, means for counteracting phase mismatch in the region of the crossover frequency; to provide structures having the foregoing advantages which can be economically fabricated by molding plastic material such as rigid polyurethane foam; and for additional purposes as will be understood from a reading of the following description of a preferred embodiment of the invention, taken in conjunction with the accompanying drawings.

DETAILED DESCRIPTION

Figure 1:
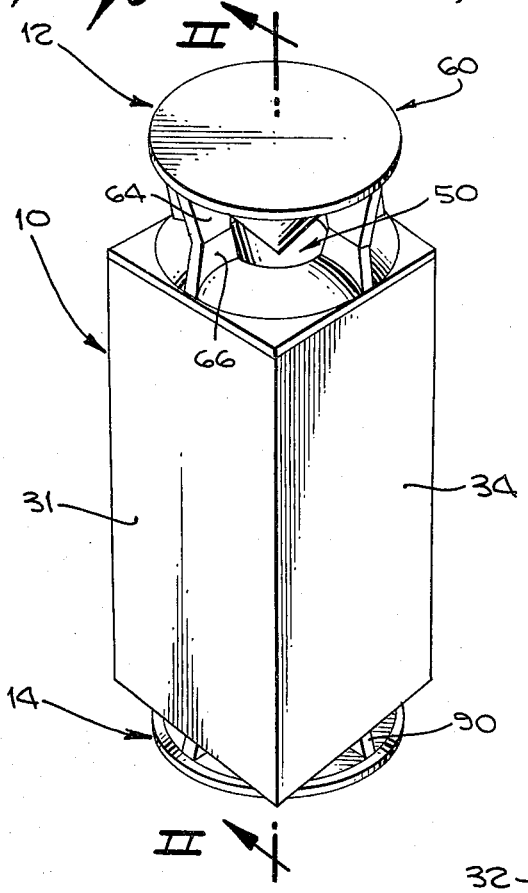
FIG. 1 is a perspective view of a typical speaker assembly in accordance with the invention.

Referring now in detail to the drawings, a speaker system of the present invention as seen in FIG. 1 includes an enclosure indicated generally at 10 having a polygonal cross section, here rectangular, and including upper tweeter and lower woofer assemblies respectively indicated generally at 12 and 14.

Figure 2:
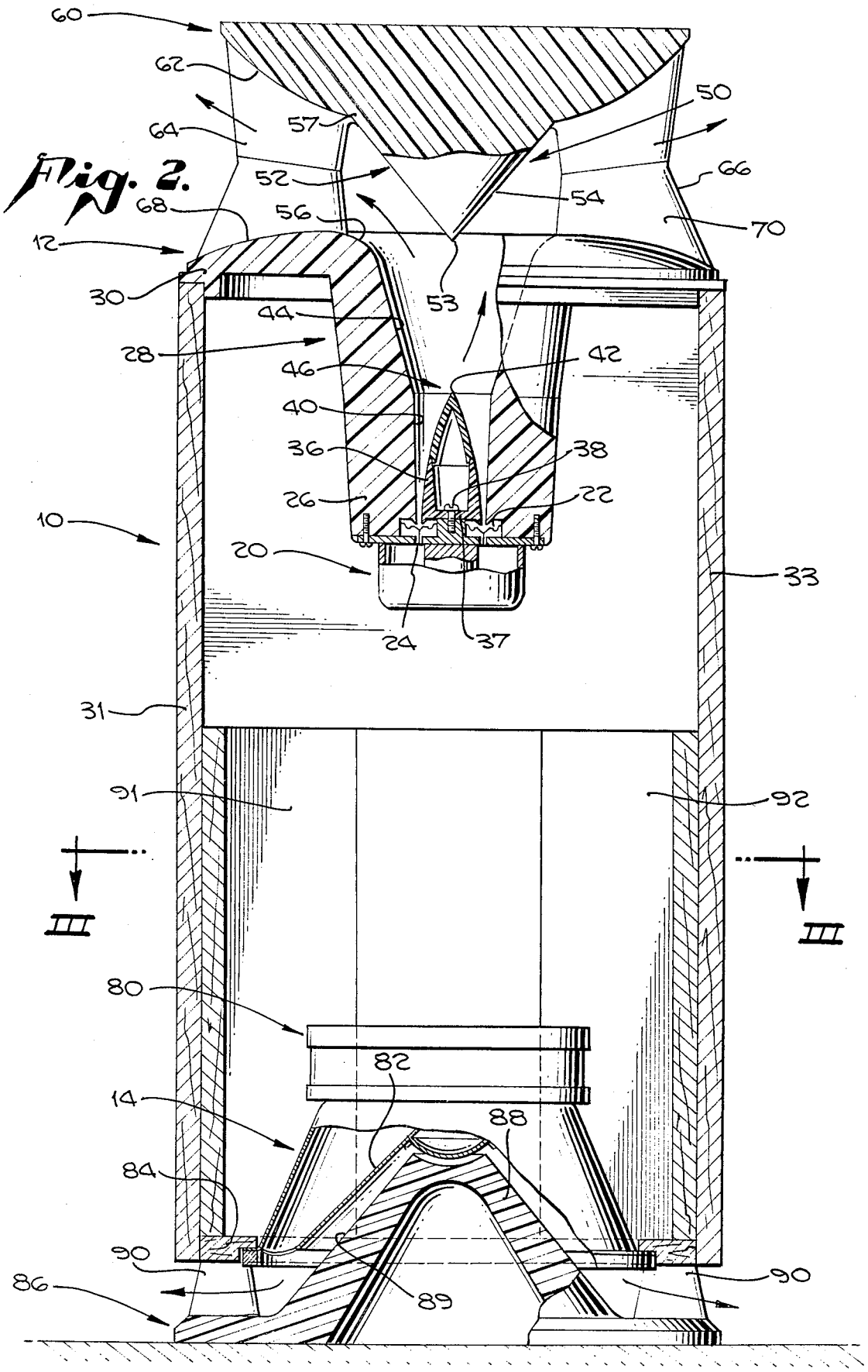
FIG. 2 is a vertical sectional view taken on arrows II—II of FIG. 1.

As seen in FIG. 2, tweeter assembly 12 includes a compression driver indicated generally at 20 provided with, in the illustrative form of the invention shown, an annular diaphragm 22 connected in conventional manner to a voice coil 24 positioned in the air gap of the magnetic field of the driver. The driver is mounted on the lower end 26 of a tweeter horn indicated generally at 28, which includes a mounting rim 30 supported by the upper edges of the four vertical side walls 31, 32, 33 and 34 of enclosure 10 and sealing therewith.

A horn throat plug 36 includes a lower horizontal wall 37 rigidly attached by means 38 to the driver, and defines with the inner wall 40 an annular horn throat portion receiving acoustic energy from the diaphragm 22 and flaring upwardly, preferably exponentially, to the plug tip 42. Above the tip the exponential or other selected flare continues, the inner wall portion 44 defining the horn portion above the plug tip. The horn portions defined by wall 44 may be referred to as the axial mid-section of the complete horn of the high frequency speaker, that section being indicated generally at 46. It will be understood that the tweeter assembly is symmetrical about its vertical central axis.

Immediately above axial mid-section 46 and receiving acoustic energy therefrom is a deflecting section indicated generally at 50 and characterized by the continuation of the exponential flaring of the axial sections and by the provision of reflector means for changing the direction of the radiated acoustic energy in the horn by an angle of substantially 90°. The reflector means is here shown as a conical member indicated generally at 52 in coaxial vertical alignment above tweeter driver 20 and axial horn section 46, and having a downwardly pointed apex 53 with an included angle of about 90°. The conical side wall 54 of reflector 52 defines, with annular wall portion 56 above wall portion 44, an annular continuation of the exponentially flaring axial section 46. In order to insure reflection of the high frequencies, the diameter of base 57 of the reflector is essentially equal to the diameter of the axial horn at the horizontal plane containing reflector apex 53.

The base of reflector 52 is formed integrally with a cover member indicated generally at 60 having a lower annular wall 62, and the cover is provided with a set, here four, of thin support fins 64 spaced equally about the central axis of the system, and supported on the upper edges of the same number of lower support fins 66 formed integrally with the lower part of the horn previously described. That lower portion, radially outwardly of wall portion 56, includes an upwardly directed wall 68 which defines, with annular wall 62, an exponentially flaring annular horn constituting the mouth or output section 70 of the horn and receiving acoustic energy from the deflector section of the horn including deflector 52 and wall portion 56.

With reference to the lower part of FIG. 2, woofer assembly 14 includes a speaker indicated generally at 80 having a conical diaphragm 82 of conventional construction. Speaker 80 is peripherally supported by attachment to an enclosure mounting plate 84, and a support indicated generally at 86 includes an upwardly projecting segment 88 having a frusto-conical outer wall 89 constituting a loading plug for the woofer and coaxial therewith. The apex angle of the conical wall 89 is chosen to be approximately congruent with the apex angle of the diaphragm 82 but displaced for clearance, so that the diaphragm and wall define therebetween an annular horn flaring downwardly and outwardly throughout 360° to distribute the acoustic output of the woofer uniformly about the speaker into the listening area.

The use of a downward facing woofer loudspeaker loaded by a plenum chamber with bipolar restrictive openings discharging at the floor plane is well known to the art and widely used for its superior low end bass response despite the low pass filter effect caused by the compliance of the air in the plenum chamber in combination with the reactance of the restrictive discharge ports. In practice, this method limits systems to a low crossover frequency, usually in the range of 300 to 400 Hertz. Practically the lowest desirable crossover usable with the omnidirectional horn of this invention is in the area of 500 to 800 Hertz, approximately one octave above the response of the conventional plenum chamber loaded woofer. In addition, a 360° distribution is required to match the tweeter radiation pattern in the region of the crossover frequency.

U.S. Pat. No. 3,329,235 to Shaper meets part of this problem, showing the use of a short cylindrical plug whose upper periphery forms a restrictive passage with the face of the speaker cone, providing a 360° discharge for the plenum chamber formed between the upper face of the cylinder and the cone, but this combination of plenum chamber volume compliance and the reactance of the annular restrictive passage still results in an undesireably low crossover frequency limitation, as discussed in the Shaper patent.

The use of a loading plug 88 whose upper surface 89 is congruent to the face of the cone 82, but spaced away from it to provide clearance for the cone's maximum excursion, reduces the enclosed air volume to a minimum. The flared annular passage between the cone face and the loading plug now represents a short conical horn loading the face of the cone, and causes an increase in output in the frequency range above the upper limits of the plenum chamber mode. The system designer can modify the clearance between the cone and the plug and/or the angular deviation from plug congruency to the cone face to optimize the performance of any given woofer speaker: if the plug face included angle is more obtuse than the face of the cone, the operation will approach the plenum chamber mode; if more acute, the conical flare rate is increased, thus increasing the upper end of the woofer's output, as is desirable for the reasons mentioned above. Decreasing the spacing between the cone and plug increases acoustic resistance and damping.

The woofer's annular horn mouth couples to the listening area at the junctions between the enclosure and the floor, presenting a $2\pi$ steradian load to the woofer, an arrangement which is much more effective than the $4\pi$ steradian mode characteristic of conventional loudspeaker systems.

In addition to segment 88, support 86 includes a set of narrow vertically extending legs 90, preferably four in number, spaced equally angularly about the central axis, and serving to support the enclosure.

It is well known in the art that accurate reproduction of an extended true bass response is affected by the handling of the radiation from the rear of the woofer cone. The woofer in the present invention could be mounted in an unvented configuration, or air suspension, by providing a centrally apertured mounting panel around the outer edge of the compliance of the woofer cone, the outer panel edges being fitted to the four walls of the enclosure in substantially airtight relation.

However, it is preferred in the present invention to provide a vented enclosure for the woofer, including a plurality of vertically extending ducts or vents of triangular section, one vent in each of the four inner corners of the enclosure.

Figure 4:
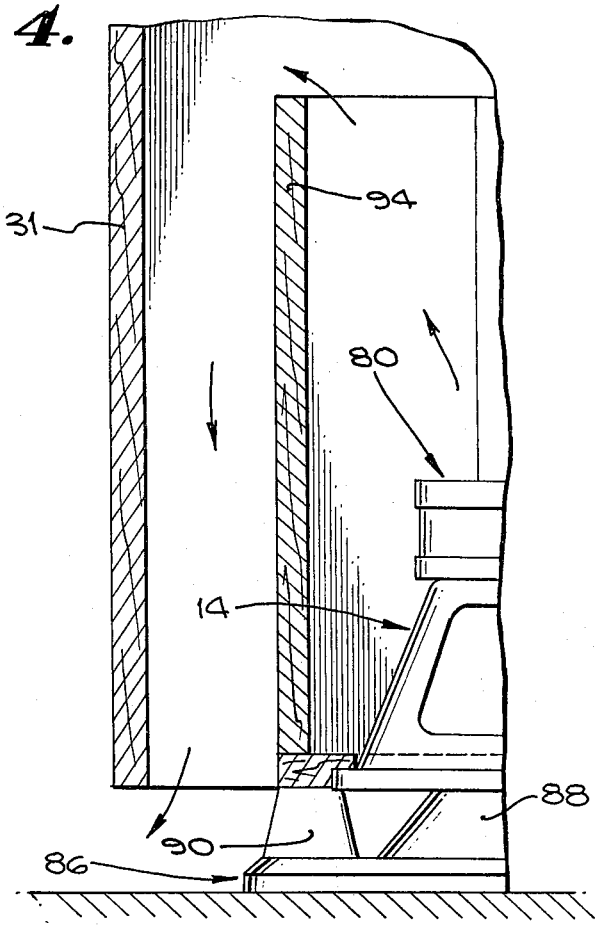
FIG. 4 is a fragmentary sectional view taken on arrows IV—IV of FIG. 3.
Figure 3:
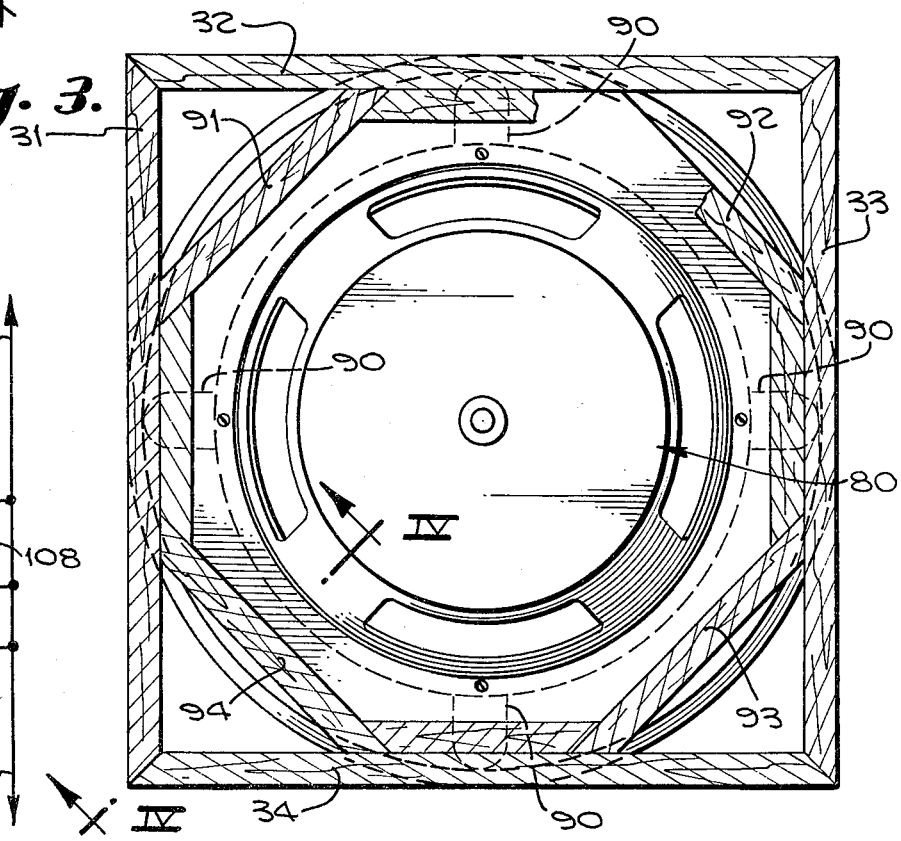
FIG. 3 is a horizontal sectional view taken on arrows III—III of FIG. 2.

More specifically, and referring to FIGS. 3 and 4, a set of four panels 91, 92, 93 and 94 extend between and at 45° to adjacent side walls of the enclosure, projecting upwardly within the enclosure to well above the woofer proper. The cross section area of these ducts and their lengths relate to the enclosed volume of the enclosure and to the characteristics of the low frequency driver according to well known principles of bass reflex enclosure design. The four panels forming the ducts also act as angular braces damping panel resonances in the enclosure, and reduce standing waves within the housing by forming an octagonal inner shape rather than a square section.

Figure 5:
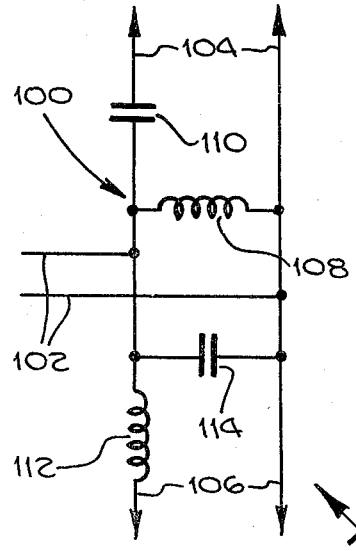
FIG. 5 is a schematic diagram showing a typical crossover network used in the present invention.

In FIG. 5 a conventional crossover network is indicated generally at 100, adapted to receive a signal in input leads 102 and to supply high and low frequency output signals to leads 104 and 106 respectively, for connection to the respective transducers in suitable manner. Crossover 100 includes a high pass filter network comprising inductor 108 and capacitor 110, and a low pass filter network comprising inductor 112 and capacitor 114.

Enclosure or housing 10 is shown and described herein as rectangular in section, preferably square or substantially so. However, the housing may more broadly be considered tubular and may be so defined herein.

The vertex angle of woofer conical diaphragm 82 is here shown as approximately 90°, but the angle may vary substantially from that value, under some conditions approaching or even equalling 180°, i.e. a flat diaphragm. Thus the word cone as used herein is to be understood in that sense.

What is claimed is:

1. A loudspeaker system comprising:

a generally tubular housing having a central vertical axis;

a high frequency electroacoustic transducer and a central axis horn receiving acoustic energy from said transducer and radiating said energy along said axis;

means for reflecting and diffracting the radiated energy approximately 90° radially 360° about said axis;

a radial horn for radiating said reflected and diffracted energy 360° about said axis;

a low frequency electroacoustic transducer including a cone centered on said axis for radiating acoustic energy along said axis in a direction opposite to that of the energy radiated by said high frequency transducer;

a loading plug having a contour substantially congruent with the cone and disposed in acoustic loading relation therewith;

and a crossover network for dividing the audio spectrum into high band pass and low band pass signals and feeding the signals to the respective transducers, the effective length of said central axis horn being selected to virtually equalize the arrival times of the radiated acoustic energies in a listening area spaced laterally from the housing, by compensating for phase shift caused by the crossover network and the relative locations of the transducers.

2. The invention as defined in claim 1 wherein the high and low frequency transducers radiate upwardly and downwardly respectively.

3. The invention as defined in claim 1 wherein the central axis horn, the reflecting and diffracting means, and the radial horn form a continuous intensifying horn of expanding cross-sectional area.

4. The invention as defined in claim 1 wherein the reflecting and diffracting means is of generally conical shape.

5. The invention as defined in claim 4 wherein the reflecting and diffracting means subtends approximately the diameter of the said central axis horn in a plane normal to the vertex of the reflecting and diffracting means.

6. The invention as defined in claim 4 wherein the reflecting means has a vertex angle of approximately 90°.

7. The invention as defined in claim 1 wherein the length of the central axis horn is pre-selected to provide a desired phase lag between the acoustic energy radiated by said transducer and the acoustic energy radiated by the radial horn.

* * * * *